United States Patent [19]

Asada et al.

[11] 4,435,832

[45] Mar. 6, 1984

[54] SPEECH SYNTHESIZER HAVING SPEECH TIME STRETCH AND COMPRESSION FUNCTIONS

[75] Inventors: Akihiro Asada; Kazuhiro Umemura; Tadashi Saito; Tohru Sampei, all of Yokohama, Japan

[73] Assignee: Hitachi, Ltd., Tokyo, Japan

[21] Appl. No.: 192,222

[22] Filed: Sep. 30, 1980

[30] Foreign Application Priority Data

Oct. 1, 1979 [JP] Japan ..... 54-125416

[51] Int. Cl.[3] ..... G10L 1/00

[52] U.S. Cl. ..... 381/34; 381/51

[58] Field of Search ..... 179/1 SA, 1 SM, 15.55 R, 179/15.55 T, 1 SG; 364/723, 724; 381/34, 35, 51, 53

[56] References Cited

U.S. PATENT DOCUMENTS

| | | | |
|---|---|---|---|
| 3,706,929 | 12/1972 | Robinson et al. | 179/1 SA |
| 3,908,085 | 9/1975 | Gagnon | 179/1 SG |
| 3,982,070 | 9/1976 | Flanagan | 179/1 SM |
| 4,020,291 | 4/1977 | Kitamura et al. | 179/15.55 T |
| 4,021,616 | 5/1977 | Betts | 179/15.55 T |
| 4,052,563 | 10/1977 | Noda | 179/15.55 R |
| 4,209,844 | 6/1980 | Brantingham | 179/1 SM |

OTHER PUBLICATIONS

Cole, "A Real-Time Floating Point Vocoder", IEEE Conf. Record, Acoustics, Speech, 1977, pp. 429–430.

David, "Note on Pitch-Synchronous Processing of Speech", J. of Acoustic Soc. of Am., Nov. 1956, pp. 1261–1266.

Smith, "Single Chip Speech Synthesizers", Computer Design, Nov. 1978, pp. 188–192.

*Primary Examiner*—E. S. Matt Kemeny

*Attorney, Agent, or Firm*—Antonelli, Terry & Wands

[57] ABSTRACT

A speech synthesizer is disclosed with the capability of stretching and compressing the speech time base without changing the pitch of the synthesized speech. One frame of speech is represented during a given time base by LPC parameters which are sampled a constant number of times per frame and stored in memory. Speech is synthesized by fetching each of the stored LPC parameters for each frame and subjecting the parameters to interpolation, synthesizing the interpolated parameters and converting the synthesized parameters to analog format. A decrease in the speed of the reproduced speech is produced by lengthening the time interval of interpolation between the fetching of each of the stored LPC parameters which have been previously stored for each frame. An increase in the speed of the reproduced speech is produced by decreasing the time interval of interpolation between the fetching of each of the stored LPC parameters which have been previously stored in each frame.

14 Claims, 10 Drawing Figures

SPEECH SYNTHESIZER HAVING SPEECH TIME STRETCH AND COMPRESSION FUNCTIONS

The present invention relates to a speech synthesizer and more particularly to a speech synthesizer capable of stretching and compressing only the speech synthesizing time, i.e. time base, without changing the pitch frequency of the synthesized speech.

The simplest method to stretch and compress the playback time of speech is the magnetic audio recording and reproducing method using a magnetic tape. When the tape transport speed is double in playback mode, the playback time is reduced to ½. On the other hand, if that speed is ½, the playback time is stretched double. In this case, the pitch frequency of the speech reproduced is changed double or ½. Therefore, this method is unsuitable for high fidelity reproduction. There is known a method capable of stretching and compressing only the playback time without changing the pitch frequency. In this method, the waveform of one wave-length of a pitch frequency of a speech signal or of multiples times its wave-length is truncated from the speech signal. The truncated waveform is repetitively used with the same waveform or several truncated waveforms are discarded for compressing the playback time. This method successfully stretches and compresses the playback time without changing the frequency of the speech. However, it has a problem in truncating the waveform; at the joints where the truncated waveforms connect, phase shifts occur to distort speech. Many approaches have been made to solve this distortion problem, but have failed to attain a simple stretch/compression of speech. One of such approaches is described by David, E. E. Jr. & McDonald, H. S. in their paper entitled "Note on Pitch Synchronous Processing of Speech" in Journal Acoustic Society of America, 28, 1956a, pp 1261 to 1266. Recent remarkable progress of LSI technology has led to the development of speech synthesizer chips. U.S. Ser. No. 901,392, filed Apr. 28, 1978, assigned to Texas Instruments Inc., discloses an educational speech synthesizer which is practical in cost, size and power consumption. The speech synthesizer uses partial autocorrelation (PARCOR), commposed of three chips of a mask ROM, a microcomputer, and a syntheiszer LSI. However, the speech synthesizer is constructed with no consideration of the technique that the synthesizing time is stretched and compressed without changing the pitch frequency.

Accordingly, an object of the present invention is to provide a speech synthesizer capable of stretching and compressing the speech time without changing the frequency of the reproduction speech.

Another object of the present invention is to provide a speech synthesizer which easily synthesizes speech accompanied by the stretching and compressing of the playback time, without distortion of the reproduced speech.

Yet another object of the present invention is to provide a speech synthesizer which provides a high fidelity even at low and high reproduction speeds relative to a standard reproduction speed without losing the pitch of the original signal, and which is suitable for uses such as learning machines, for example, an abacus trainer.

The speech synthesizer according to the invention uses a synthesizing method by a linear predictive coding (LPC) method for changing the time interval, i.e. a frame, of analysis and that of synthesizing. When the time interval exceeds 20 ms the reproduced speech is coarse. For avoiding this, the linear predictive coefficients are interpolated with the time interval of 5 ms or less. The time interval of interpolation of 5 ms or less provides an appreciable difference in the effects. When the time interval of interpolation is 10 ms or more, the speech reproduced is coarse and the interpolation applied is ineffective.

When speech synthesis is applied to various uses, especially consumer products or educational equipment, it is necessary to change speech speed without changing pitch frequency. In this system, the speech speed is changed by varying the frame period of speech synthesizer.

When the speech data, which is obtained by analysis of a standard frame period, e.g. 10 msec, is renewed at a frame time of shorter than the standard period, e.g. 9 msec, the speech speed is increased by 10%. The speech speed is lowered by updating the speech data at a frame period longer than the standard. By this process, the speech data itself does not change, so the pitch frequency does not change. In this system ten speeds of the speech can be selected at increments of 10%.

According to the present invention, speech can be synthesized without distortion and no shift of frequency, allowing the functions of the stretching and compression of the speech time. This was conventionally very difficult because of the waveform truncation (windowing).

In accordance with an embodiment of the invention, one frame of speech is represented every 20 milliseconds by LPC parameters which are stored in the form of a constant number of samples of the LPC parameters per frame which are derived sequentially at 2.5 millisecond intervals. Speech at the original speed is synthesized by fetching the stored LPC parameters for each frame over an identical 20 milliseconds frame interval by interpolating between samples also spaced 2.5 milliseconds apart. If speech is desired at a speed different than the original speed, the LPC parameters are fetched over a frame interval different from the 20 milliseconds frame during which the LPC parameters were stored by the use of the same number of samples as the number of samples stored per frame of speech. Thus, for example, speech can be reproduced at one-half of the storage rate by stretching the frame interval from 20 to 40 milliseconds by sampling the stored LPC parameters over spacd apart intervals equal in number to the stored number of LPC parameters per frame and interpolating the speech between the spaced apart samples.

Other objects and features of the invention will be apparent from the following description taken in connection with the accompanying drawings, in which:

FIGS. 1*a* to 1*c* show speech spectra useful in explaining the speech synthesizing of the PARCOR type;

Before proceeding with an embodiment of the present invention, a brief description will be given about a speech spectrum and a speech synthesizing method of the PARCOR type as an example of the linear predictive coding method.

Figure 1A:
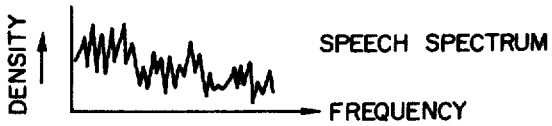
Figure 1B:
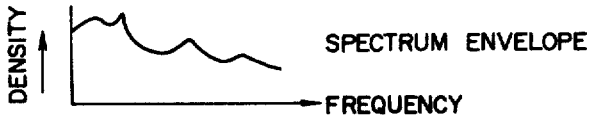
Figure 1C:
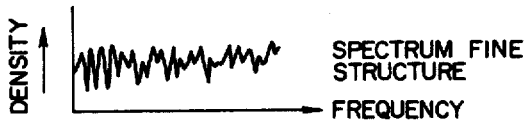

FIGS. 1*a* to 1*c* show graphical representations of the result of frequency-analyzing a sound "o". A waveform shown in FIG. 1*a* represents an overall spectrum. The overall spectrum may be considered as the product of a spectrum envelope gently changing with frequency, as shown in FIG. 1*b*, and a spectrum fine structure sharply changing with frequency, as shown in FIG. 1*c*. The spectrum envelope mainly represents a resonance characteristic of a vocal tract, including the information of vocal sounds such as "a" and "o". The spectrum fine structure contains information of the pitch of the speech or a degree of height of sound. The PARCOR coefficient is physically the characteristic parameter representative of a vocal tract transfer characteristic. Hence, if a filter characteristic representing the speech is expressed in terms of PARCOR coefficient, the speech could be synthesized.

Figure 2:
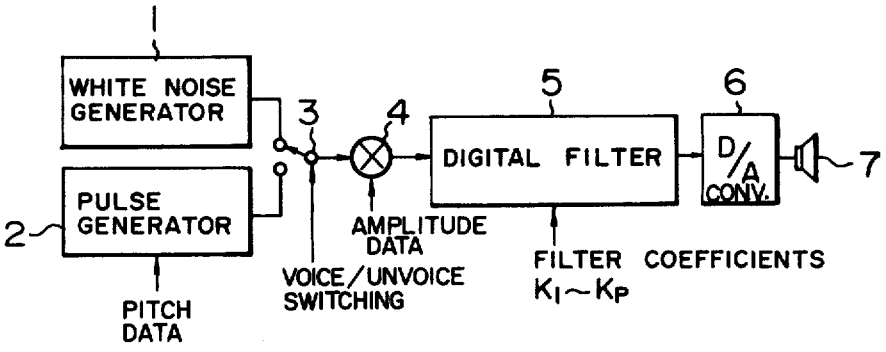
FIG. 2 is a block diagram of a basic construction of the PARCOR type speech synthesizer.

A basic construction of the PARCOR speech synthesizer is shown in block form in FIG. 2. In FIG. 2, reference numeral 1 designates a white noise generator; 2 a pulse generator; 3 a voice/unvoice switch; 4 a multiplier; 5 a digital filter; 6 a D/A converter; and 7 a loud speaker. In synthesizing the speech, voice/unvoice judging information on the basis of the data obtained by analyzing a natural vocal sound, pitch information, volume (amplitude) information, kl to kp parameters (P is the positive integer) as PARCOR coefficients are time-sequentially applied to the speech synthesizer.

Figure 3:
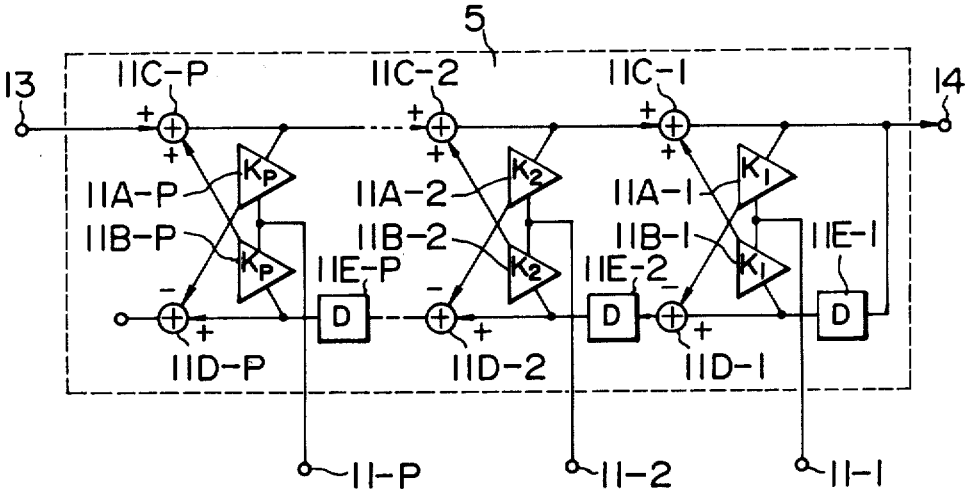
FIG. 3 is a circuit diagram of a digital filter used in the speech synthesizing section.

A construction of a digital filter 5 is shown in FIG. 3. In the Figure, 11-1 designates a primary PARCOR coefficient input; 11-2 a secondary PARCOR coefficient input; 11-P a P-degree input; 11A and 11B multipliers; 11C and 11D adders; 11E a delay memory. As shown, the PARCOR coefficients are applied to the respective multipliers. Reference numerals 13 and 14, respectively, denote a pulse input terminal and an output terminal of the synthesized speech.

When pulse or white noise is applied to the input terminal 13 of the filter, the output signal from the output terminal 14 exhibits the same spectrum envelope characteristic as that of speech. The output signal is converted by a D/A converter 6 into an analog signal, from which a speech signal in turn is reconstructed by the loud speaker 4.

The PARCOR speech synthesizer technique involving the concept of the present invention is discussed in detail in the paper entitled "High Quality PARCOR Speech Synthesizer" which was presented and circulated by Sampei (the applicant of the present patent application) et al, IEEE Consumer Electronics Chicago Spring Conference held in Chicago during June 18 and 19, 1980.

An embodiment of the speech synthesizer according to the present invention will be described referring to the drawings.

Figure 4:
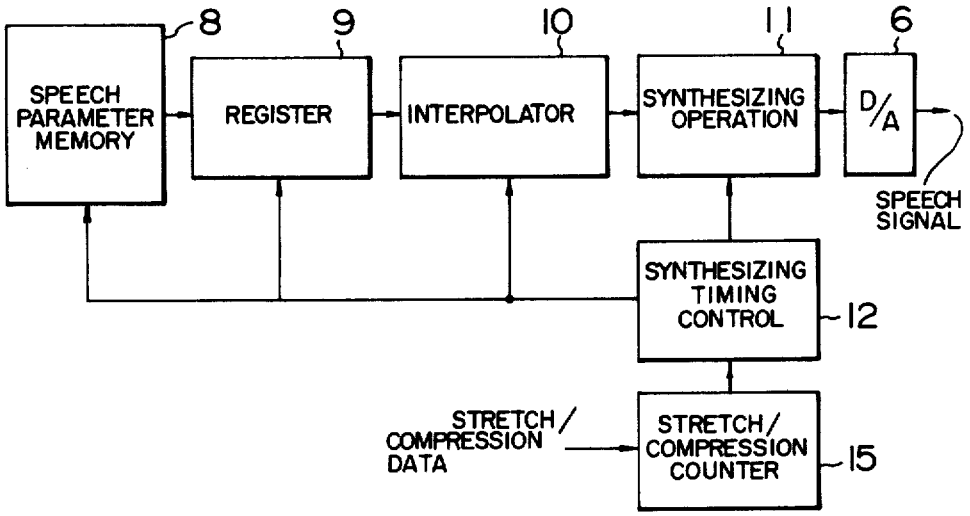
FIG. 4 is a block diagram of an embodiment of the present invention.

Reference is made to FIG. 4 schematically illustrating the speech synthesizer of the present invention. In the Figure, a speech parameter memory 8 stores data such as for PARCOR coefficients obtained by analyzing the speech wave, amplitudes, pitches, voice/unvoice switching and the like. A register 9 temporarily stores parameters delivered from speech parameter memory 8 to arrange the incoming parameters into a predetermined format within the synthesizer for the purpose of timing adjustment. An interpolation circuit (interpolator) 10 interpolates the parameters with short time intervals. A synthesizing operation circuit 11 synthesizes speech by using the parameters and includes the digital filter 5. The digital synthesized speech produced from the digital filter 5 is converted into a corresponding analog signal. Reference numeral 12 represents a synthesizing timing control section for timing signals used for the synthesizing operation circuit 11 and the inputting of the parameters. A speed stretch/compression counter 15 produces timings in accordance with a degree of the stretch and compression of the speech time in the speech synthesizing, specifically a playback speed setting signal. The above circuit configuration except memory 8 is manufactured by the present assignee as a speech synthesizing LSI type HD38880. When the speech parameter information is received from another speech analyzer in an on-line manner, the memory 8 is omissible.

The operation of the speech synthesizer as mentioned above will be described.

The present embodiment employs for the speech synthesizing the PARCOR method involved in the linear prediction coding method. In the PARCOR synthesizing method, the partial auto-correlation (PARCOR) coefficients as the linear predictive coefficients are used for the vocal parameters in synthesizing speech. The PARCOR coefficient is physically the reflection coefficient of the vocal tract. Hence, by applying the PARCOR coefficients as the reflection coefficients to a multistage digital filter, the human vocal tract model is constructed for synthesizing speech. The PARCOR coefficients are previously obtained through analyzing the natural speed or the human speech by a computer or a speech analyzer. Since the human speech gradually changes, it is cut out at a time interval from 10 ms to 20 ms. The PARCOR coefficients are obtained from the fragmental speech sample. As the time interval, called "frame", is shorter, the PARCOR coefficients increase. In this case, more smoothly synthesized speech is obtained, but the analyzing steps of speech increase. Incidentally, one frame is a minimum unit for determining the analysis time interval of speech. In this case, fewer samples are present within the frame. Therefore, it is difficult to sample the pitch (a degree of height of sound) data of speech. Conversely, in the case where the frame is long, the sampling problem of the pitch data is solved, but the smoothness of the synthesized speech is damaged, resulting in coarse speech. This arises from the fact that the long frame equivalent to the stepwise movement of the mouth. It is for this reason that a range of from 10 ms to 20 ms is most preferable for one frame. The present embodiment employs 20 ms for the frame. In FIG. 4, prior to the speech synthesizer 11, the register 9 receives speech parameters of one frame such as the PARCOR parameters, voice/unvoice switching signal, pitch data, and amplitude data, indirectly related to the synthesizing timing control section 12. Then, the parameters are transferred to the interpolator 10 where they are interpolated with relation to those in the preceding frame to form 8-speech parameters stepwise changing for each interpolation frame of 2.5 ms. This data is transferred to the synthesizer 11 while being updated every 2.5 ms.

Figure 5:
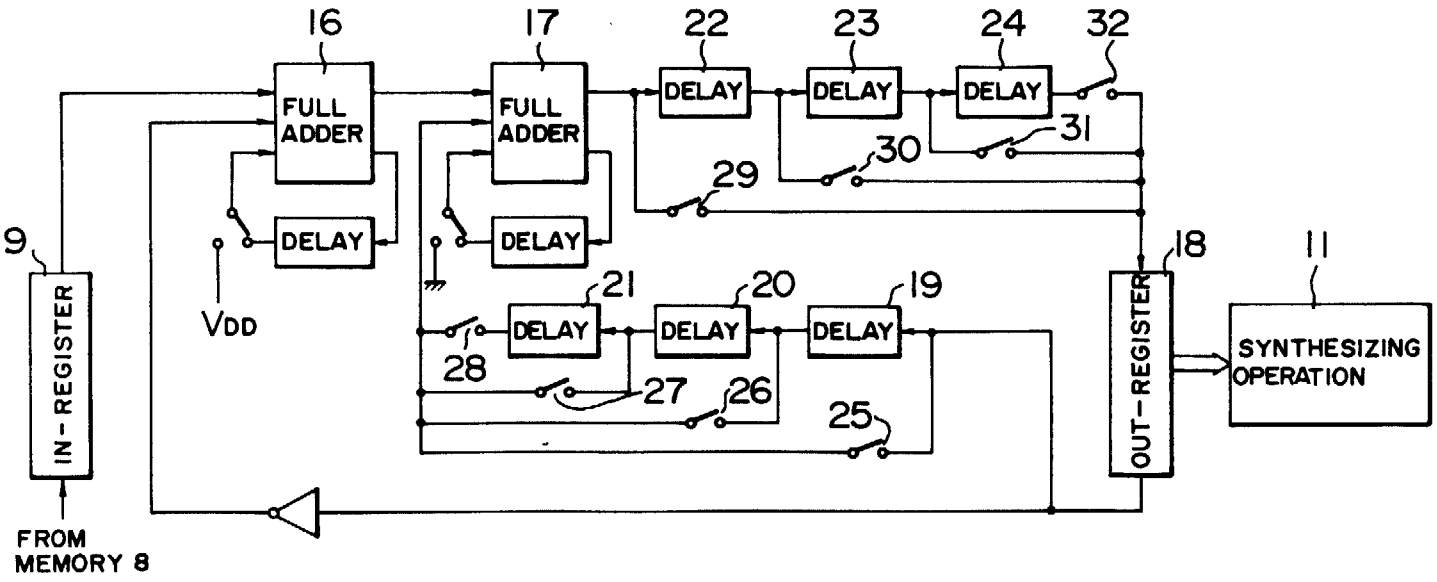
FIG. 5 is a block diagram of an interpolation circuit shown in FIG. 4.

Turning now to FIG. 5, there is shown an interpolator. In the Figure, 16 and 17 are full-adders; 18 is a register into which the result of the interpolation is loaded; 19 to 24 are delay circuits; 25 to 32 are switches for controlling delay times which change weight coefficients to be given later.

The interpolation formula is $$N_{i+1} = W(Ta - N_i) + N_i$$

where:

Ta: the target value, the value loaded in the register 9, $N_i$: the value currently used in the synthesizing operation, $N_{i+1}$: the value obtained by the interpolation, and is used in the next synthesizing operation, W: the weight coefficient. In interpolating the time interval of 20 ms with 8 divisions, it takes $\frac{1}{8}$ for obtaining the first interpolation value, $\frac{1}{8}$ for the next interpolation value, and subsequently $\frac{1}{3}$, $\frac{1}{4}$, $\frac{1}{4}$, $\frac{1}{2}$, and 1/1.

In this circuit, the parameters are serially interpolated serially one by one. Firstly, a difference between the target value in the register 9 and the present value in the register 18 is calculated by the full adder 16. The combination of the delay circuits 19 to 21 and the switches 25 to 28 provides weight coefficients $\frac{1}{8}$ to 1/1. The output of the full adder 16 and the output of the delay circuit are applied to the full adder 17 where a new interpolation value is obtained. The combination of the delay circuits 29 to 32 and the switches 29 to 32 keeps one machine cycle constant. The interpolation values thus obtained are applied to the synthesizing operation circuit 11. The synthesizing operation circuit performs a given synthesizing operation every 125 μs. The reason why the 125 μs is selected is that to synthesize the speech of the frequency band up to 4 KHz, the sampling theory requires the samples two times the frequency band. Therefore, the synthesizing operations are performed 20 times for 2.5 ms, using the same PARCOR coefficients. The result of the synthesizing operation thus obtained is subjected to the D/A conversion to be transformed into the speech. Through the above interpolation, the PARCOR coefficients stepwise change, so that the connections between the frames are smoothed. The circuit controlling the operation timing of those operations is the synthesizing timing control section 12 and the circuit transferring a reference timing to the synthesizing timing control section is the stretch/compression counter 15.

Figure 6:
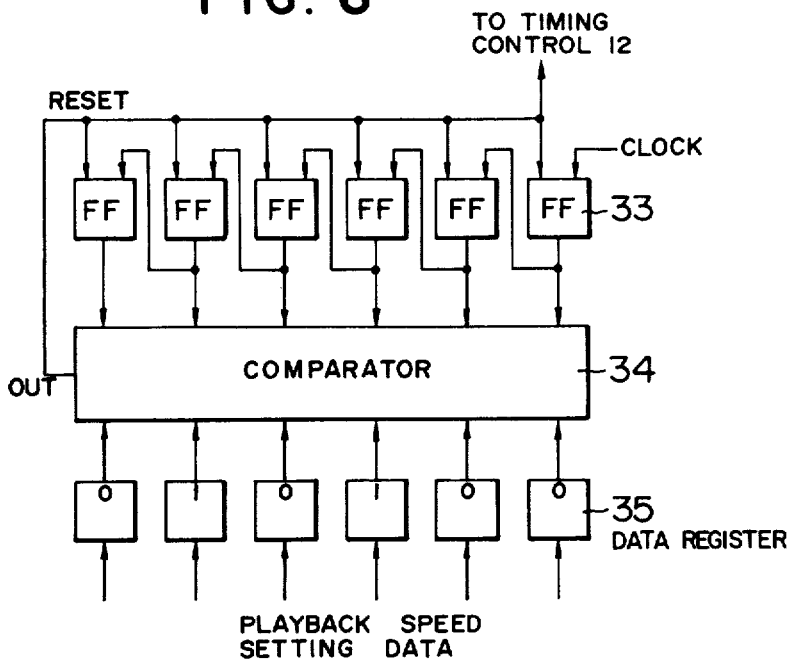
FIG. 6 is a block diagram of a stretch/compression counter.

The operation of the stretch/compression counter will be described referring to FIG. 6. At the standard synthesizing speed, a binary code, for example, 010100 representing a playback speed to be set by a microcomputer is set in a stretch/compression data register 35. A 6-bit counter 33 counts up by clock of 125 μs. When the count of the counter exceeds 010100 (20 of the decimal system), the comparator 34 is inverted to reset the counter. Then, the counter restarts its counting. In this way, the stretch/compression counter 125 μs, at the standard synthesizing speed, is reset when it counts 20 times by the 125 μs clock. It produces an output pulse every 2.5 ms for transfer to the synthesizing timing control section.

Figure 7:
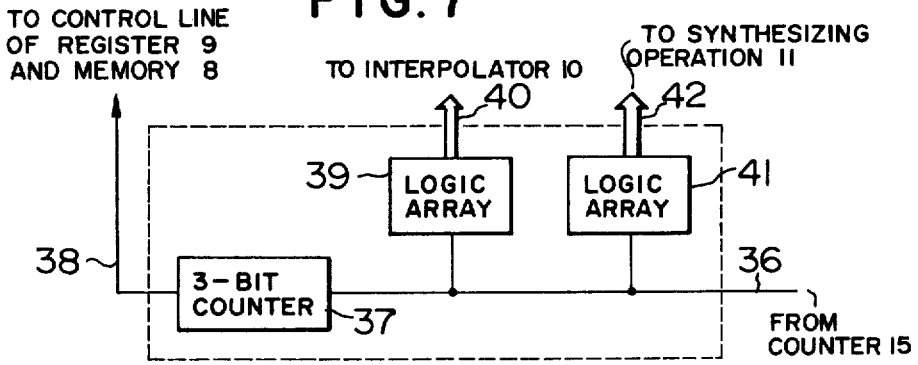
FIG. 7 is a block diagram of a synthesizing timing control circuit shown in FIG. 4.

FIG. 7 shows a block diagram of the detail of the synthesizing timing control section. In FIG. 7, reference numeral 36 is a signal line extending from the stretch/compression counter; 37 is a 3-bit counter for frequency-dividing the output signal from the stretch-/compression counter by a factor of eight; 38 is a control signal line of the memory 8 and register 9; 39 is a logic array storing a program for controlling the interpolation circuit 10; 40 is an interpolation circuit control signal line; 41 is a logic array for controlling the synthesizing operation section 11; and 42 is a control line extending to the synthesizing operation section 11. The counter 37 transfers a 20 ms pulse to the register 9 when receiving 8 pulses for the 2.5 ms interpolation. Upon receipt of the pulse, the register 9 fetches the parameters from the speech memory 8. Logic arrays 39 and 41 form various control signals on the basis of the interpolation pulse and control the interpolation circuit and the synthesizing operation section by the control signals.

Figure 8:
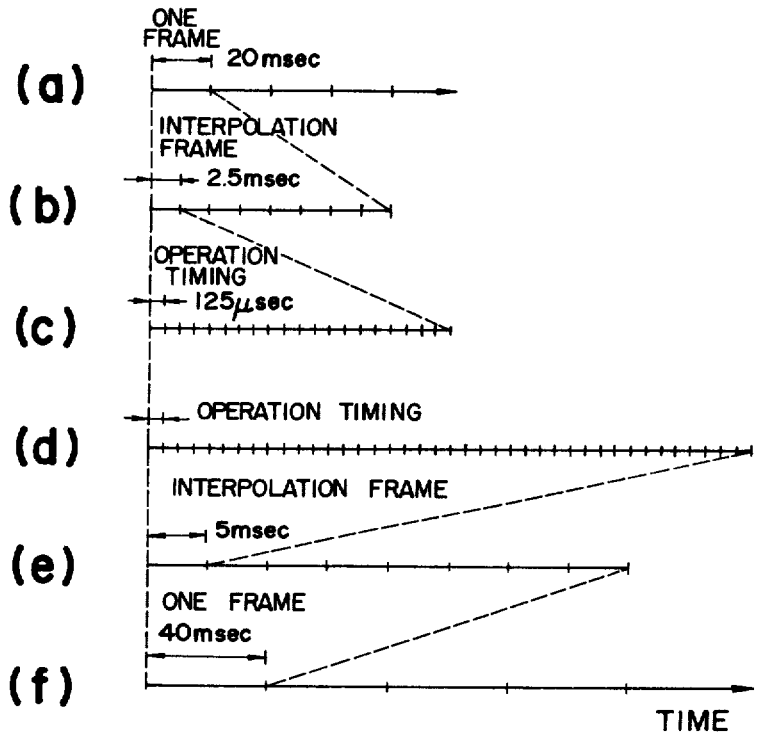
FIG. 8 shows a timing chart useful in explaining the operation of the embodiment of the present invention.

FIG. 8 shows an example of a time chart of the speech synthesizer shown in FIG. 4. As seen, in the standard state where no stretch or compression is present, the frame (the period truncated of the natural speech and the linear predictive coefficient is updated every the truncated period) is selected to be 20 ms (FIG. 8(*a*)). One frame consists of eight interpolation frmes each 2.5 ms (FIG. 8(*b*)). The synthesizing operations are performed 20 times within the interpolation period of 2.5 ms by using the linear predictive coefficients (FIG. 8(*c*)).

The operation of the speech synthesizer when the synthesizing speed is set to $\frac{1}{2}$ the standard speed, will be described referring to FIGS. 8(*d*) to 8(*f*).

A digital code 101000 is first set in the stretch/compression register 35. The counter 33 counts up under control of the 125 μs clock until the content of the counter 33 reaches 101000 (40 in the decimal system). At the 101000, the counter 33 is reset. In this way, when the stretch/compression counter counts 40 cycles under control of the 125 μs clock, it produces an output pulse for transfer to the synthesizing timing control section 12. This operation time period is the interpolation period (FIG. 8(*e*)) of 5 ms. When the counter 37 produces the output pulses of eight, a new speech parameter is loaded from the speed memory 8 to the register 9. This time interval is one frame and 40 ms. In this way, the speech synthesizing is performed by fetching the parameter from the speech memory 8 every 40 ms. Although the speech parameter is sampled from a frame of 20 ms taken out of the original speech, the speech synthesizing is performed by using the parameter every 40 ms. Therefore, the playback speed is $\frac{1}{2}$. This method is advantageous over the conventional one in that the waveform of the reproduced speech is analogous to that of the natural speech and the nature of the reproduced speech is natural. The speech parameters are those of the vocal tract model, as mentioned above. When the speech is synthesized slowly, the number of the synthesizing operations is merely increased but the operation timing and the speech parameters are the same as in the fast speech synthesizing. Accordingly, the frequency characteristic, i.e. the vocal tract characteristic, of the digital filter obtained by the operation remains unchanged. Therefore, the reproduced speech is extremely analogous to that when a man slowly pronounces.

Because of the above-mentioned interpolation, even though the synthesizing time is long, the time period that the same speech parameter is used is short. In the present embodiment, since the interpolation frame at the standard speed is 2.5 ms, it is only 5 ms even when that time is doubly elongated. It is seen that it is below 10 ms and the smoothed speech is ensured. That is, it is below 20 ms necessary for ensuring the smoothness of the reproduction speech. If the interpolation is not used, the time using the same parameter is 40 ms, resulting in poor connection of sounds. However, if the interpolation is made at the time interval of 10 ms or less, that time is 20 ms or less even if the synthesizing time is doubled. The result of the speech reproduced is smooth.

What is claimed is:

1. A speech synthesizer comprising:

(a) speech parameter providing means for providing n-linear predictive coefficients sampled from segmental waveforms truncated from natural speech at a given time interval, voice/unvoice judging information, pitch information, and volume information;

(b) speech reconstruction means including a speech synthesizing filter whose coefficients change at given intervals on the basis of the linear predictive coefficients to synthesize and provide speech in accordance with the speech parameters delivered from speech parameter providing means;

(c) interpolating means provided between said speech reconstruction means and said speech parameter providing means, for interpolating the linear predictive coefficients inputted at given intervals, at a time interval of at least 10 ms or less and for supplying the interpolated linear predictive coefficients to said speech reconstruction means; and (d) timing control means for producing a synthesizing timing signal responsive to a signal for setting a speech reproduction speed and supplying the synthesizing timing signal to said speech parameter providing means and said interpolating means for changing the time interval of interpolation of the interpolating means;

whereby the speech outputting time is stretchable and compressible without changing the pitch information provided by said speech parameter providing means while ensuring reconstruction of a smooth speech.

2. A speech synthesizer according to claim 1, wherein said speech parameter providing means is a memory for storing the speech parameters or a buffer circuit for temporarily storing the speech parameters received.

3. A speech synthesizer according to claim 1, further comprising a stretch/compression data counter coupled to said timing control means for storing a playback speed setting signal applied thereto and supplying the same to said timing control means to change the synthesizing timing signal in accordance with the playback speed setting signal.

4. A speech synthesizer according to claim 1, wherein said linear predictive coefficient is a partial auto-correlation (PARCOR) coefficient obtained from the speech samples with 10 ms to 20 ms for each frame, and said filter is a multi-stage filter.

5. A speech synthesizer capable of stretching and compressing the speech time comprising:

(a) speech parameter storing means for storing speech parameters including PARCOR coefficients sampled from segmental waveforms for a given frame period taken out from natural speech by a speech analysis;

(b) speech synthesizing means including a multi-stage digital filter whose coefficients change every frame on the basis of the PARCOR coefficients contained in the speech parameters read out from said storing means in response to said speech parameters, and execute operations to synthesize speech together with remaining parameters;

(c) interpolation means for interpolating the PARCOR coefficients for each frame read out from said storing means at a time interval of at least 10 ms or less to thereby provide the filter coefficients of said multi-stage digital filter;

(d) timing control means for producing a synthesizing timing signal responsive to a signal for setting a speech reproduction speed and supplying the synthesizing timing signal to said speech parameter storing means, and said interpolating means at a time interval different from the frame period of said speech analysis;

(e) reproduction speed setting means including a counter for updating the synthesizing timing signal of said timing synthesizing means in accordance with an input signal at a desired speech reproduction speed.

6. A speech synthesizer according to claim 1, further comprising a register coupled between said speech parameter providing means and said interpolator and coupled to receive said synthesizing timing signal from said timing control means, wherein said register includes means to temporarily store and arrange parameters received from said speech parameter providing means into a predetermined format prior to transferring said parameters to said interpolator under the control of said synthesizing timing signal.

7. A speech synthesizer according to claim 5, wherein said reproduction speed setting means comprises a data register for storing playback speed setting data and a comparator coupled to said data register and said counter to reset said counter when the count of said counter exceeds the value of said playback speed setting data.

8. A speech synthesizer comprising:

(a) speech parameter providing means for providing n-linear predictive coefficients sampled from segmented waveforms truncated from natural speech at a given time interval, voice/unvoice judging information, pitch information, and volume information;

(b) speech reconstruction means including a speech synthesizing filter whose coefficients change at given intervals on the basis of the linear predictive coefficients to synthesize and provide speech in accordance with the speech parameters delivered from speech parameter providing means;

(c) interpolating means provided between said speech reconstruction means and said speech parameter providing means, for interpolating the linear predictive coefficient inputted at given intervals, at a time interval of at least 10 ms or less and for supplying the interpolated linear predictive coefficient to said speech reconstruction means; and (d) timing control means for controlling the synthesis of speech by the speech reconstruction means at a constant rate in accordance with the speech parameters and for producing an interpolation signal of variable interval for causing the interpolation of said speech parameters from said speech parameter providing means in response to a signal for setting a speech reproduction speed.

9. A speech synthesizer according to claim 8, wherein said speech parameter providing means is a memory for storing the speech parameters or a buffer circuit for temporarily storing the speech parameters received.

10. A speech synthesizer according to claim 8, further comprising a stretch/compression data counter coupled to said timing control means for storing a playback speed setting signal applied thereto and supplying the same to said timing control means to change the synthesizing timing signal in accordance with the playback speed setting signal.

11. A speech synthesizer according to claim 8, wherein said linear predictive coefficient is a partial auto-correlation (PARCOR) coefficient obtained from the speech samples with 10 ms to 20 ms for each frame, and said filter is a multi-stage filter.

12. A speech synthesizer capable of stretching and compressing the speech time comprising:

(a) speech parameter storing means for storing speech parameters including PARCOR coefficients sampled from segmental waveforms for a given frame period taken out from natural speech by a speech analysis;

(b) speech synthesizing means including a multi-stage digital filter, which updates the coefficients of said multi-stage digital filter every frame on the basis of the PARCOR coefficients contained in the speech parameters read out from said storing means in response to said speech parameters, and executes operations to synthesize speech together with remaining parameters;

(c) interpolation means for interpolating the PARCOR coefficients for each frame read out from said storing means at a time interval of at least 10 ms or less to thereby provide the filter coefficients of said multi-stage digital filter;

(d) timing control means for controlling the synthesis of speech by the speech synthesizing means at a constant rate in accordance with the speech parameters and for producing an interpolation signal of variable interval for causing the interpolation of said speech parameters from said speech parameter providing means in response to a signal for setting a speech reproduction speed; and (e) reproduction speed setting means including a counter for updating the interpolation signal of said timing control means in accordance with an input signal at a desired speech reproduction speed.

13. A speech synthesizer according to claim 8, further comprising a register coupled between said speech parameter providing means and said interpolator and coupled to receive said synthesizing timing signal from said timing control means, wherein said register includes means to temporarily store and arrange parameters received from said speech parameter providing means into a predetermined format prior to transferring said parameters to said interpolator under the control of said synthesizing timing signal.

14. A speech synthesizer according to claim 12, wherein said reproduction speed setting means comprises a data register for storing playback speed setting data and a comparator coupled to said data register and said counter to reset said counter when the count of said counter exceeds the value of said playback speed setting data.

* * * * *